US009210960B1

(12) United States Patent
Linn

(10) Patent No.: US 9,210,960 B1
(45) Date of Patent: Dec. 15, 2015

(54) HAIR STYLE ACCOMMODATING HAT DEVICE

(71) Applicant: Stacey Linn, Titusville, FL (US)

(72) Inventor: Stacey Linn, Titusville, FL (US)

( * ) Notice: Subject to any disclaimer, the term of this patent is extended or adjusted under 35 U.S.C. 154(b) by 279 days.

(21) Appl. No.: 13/743,998

(22) Filed: Jan. 17, 2013

(51) Int. Cl.
*A42B 1/02* (2006.01)
*A63H 33/04* (2006.01)
*A42B 1/00* (2006.01)

(52) U.S. Cl.
CPC . *A42B 1/02* (2013.01); *A42B 1/004* (2013.01); *A63H 33/048* (2013.01)

(58) Field of Classification Search
CPC ..... A42B 1/004; A42B 1/04; A42B 1/041; A42B 1/045; A42B 1/046; A42B 1/12; A42B 1/205; A42B 1/24; A42B 1/248; A63H 33/048
USPC ..... 2/209.13, 209.14, 244, 209.3, 209.4; 132/200, 270, 275, 53; 446/27; D2/866, 875, 895
See application file for complete search history.

(56) References Cited

U.S. PATENT DOCUMENTS 3,972,075 A * 8/1976 Alevras ..... 2/174
4,267,850 A * 5/1981 Barrett ..... 132/270
5,170,509 A * 12/1992 Leopold ..... 2/195.1
5,203,358 A * 4/1993 Eytcheson ..... 132/212
5,239,705 A * 8/1993 Leopold ..... 2/209.13
D340,344 S * 10/1993 McPherson ..... D2/884
5,321,854 A 6/1994 Kronenberger
D405,590 S 2/1999 Bartz
5,875,494 A * 3/1999 Garnier et al. ..... 2/209.7
5,933,872 A * 8/1999 Lema ..... 2/209.7
D420,207 S 2/2000 Barton et al.
D422,777 S * 4/2000 Scott ..... D2/869
D424,282 S * 5/2000 Crumpton et al. ..... D2/876
D442,746 S * 5/2001 Belcher ..... D29/122
6,256,796 B1 * 7/2001 Fleming ..... 2/209.13
D458,734 S * 6/2002 Clair ..... D2/869
6,711,749 B2 * 3/2004 White et al. ..... 2/195.8
D500,580 S * 1/2005 Rothschild ..... D2/866
D501,957 S * 2/2005 Jagger ..... D29/122
7,010,815 B2 3/2006 Tufano-Sisca
D611,200 S * 3/2010 Packard ..... D29/122
7,945,971 B2 * 5/2011 Garza ..... 2/209.3
RE43,407 E * 5/2012 Duffy et al. ..... 2/175.7
D674,969 S * 1/2013 Ratner et al. ..... D29/102
8,418,266 B1 * 4/2013 Pike ..... 2/209.13
2005/0066421 A1 3/2005 Brundage
2006/0021111 A1 * 2/2006 Footman, Jr. ..... 2/209.13
2006/0021117 A1 * 2/2006 Madonia ..... 2/422
2006/0191057 A1 * 8/2006 Lynn ..... 2/171
2007/0250987 A1 11/2007 Adkins
2007/0283975 A1 * 12/2007 Ma ..... 132/53
2008/0092272 A1 4/2008 Vainio et al.
2009/0083898 A1 * 4/2009 Shirey ..... 2/209.7
2009/0199323 A1 8/2009 Zakarian
2011/0296589 A1 * 12/2011 Fine et al. ..... 2/244
2013/0180538 A1 * 7/2013 Martinelli ..... 132/200

* cited by examiner

*Primary Examiner* — Khaled Annis

(57) ABSTRACT

A hair style accommodating hat device permits wearing a hat displaying a hair style or the appearance of a hair style commonly referred to as a mohawk. The device includes a main member having an annular perimeter edge and a convex central portion extending from the perimeter edge defining an interior space wherein the main member is configured to be worn on a head. An elongated slot extends through the central portion of the main member. The slot has spaced longitudinal side edges wherein the slot is configured for receiving an elongated strip of hair through the slot while the main member is coupled to the head.

8 Claims, 4 Drawing Sheets

HAIR STYLE ACCOMMODATING HAT DEVICE

BACKGROUND OF THE DISCLOSURE

Field of the Disclosure

The disclosure relates to hat devices and more particularly pertains to a new hat device for permit wearing a hat displaying a hair style or the appearance of a hair style commonly referred to as a mohawk.

SUMMARY OF THE DISCLOSURE

An embodiment of the disclosure meets the needs presented above by generally comprising a main member having an annular perimeter edge and a convex central portion extending from the perimeter edge defining an interior space wherein the main member is configured to be worn on a head. An elongated slot extends through the central portion of the main member. The slot has spaced longitudinal side edges wherein the slot is configured for receiving an elongated strip of hair through the slot while the main member is coupled to the head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
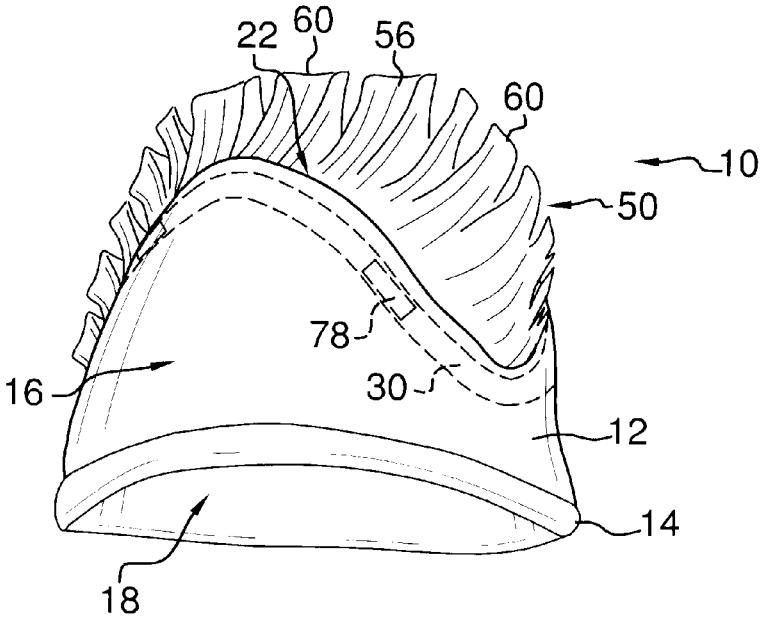
FIG. 1 is a bottom front side perspective view of a hair style accommodating hat device according to an embodiment of the disclosure.
Figure 2:
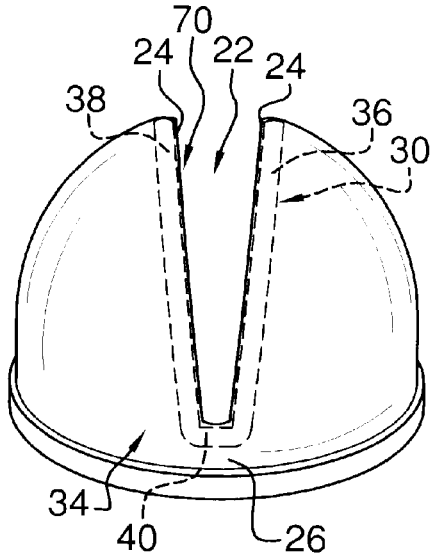
FIG. 2 is a top back perspective view of an embodiment of the disclosure.
Figure 3:
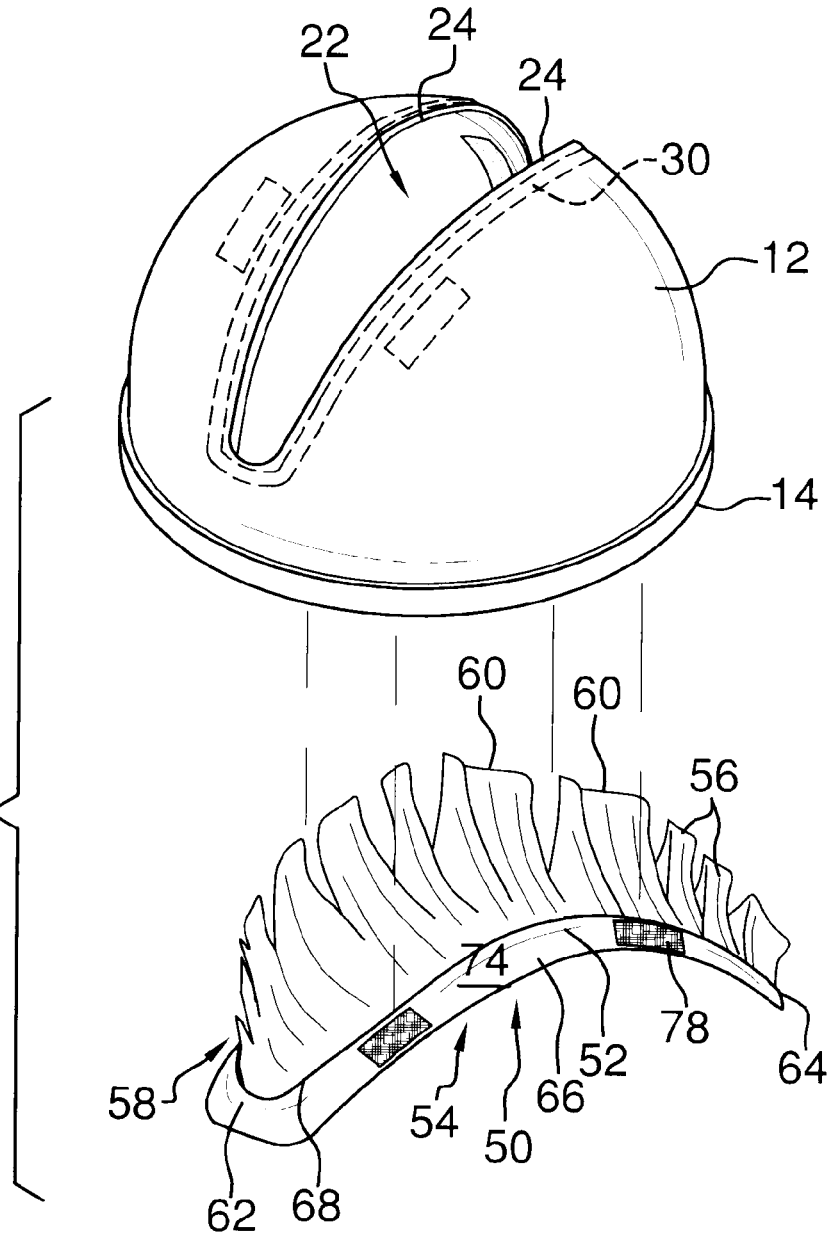
FIG. 3 is a partially exploded front top side perspective view of an embodiment of the disclosure.
Figure 4:
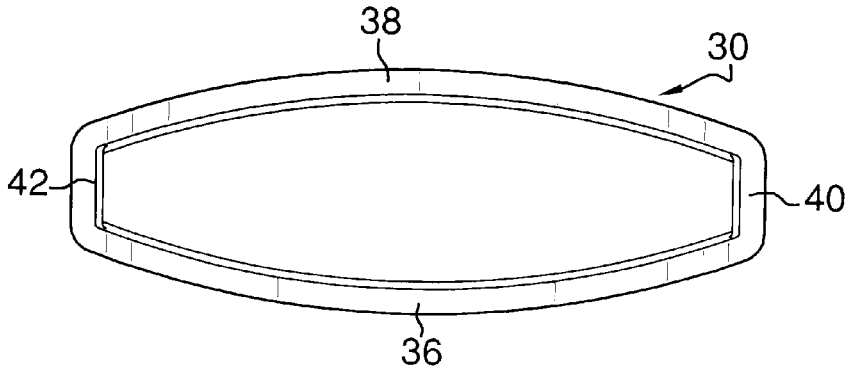
FIG. 4 is a top view of an embodiment of the disclosure.
Figure 5:
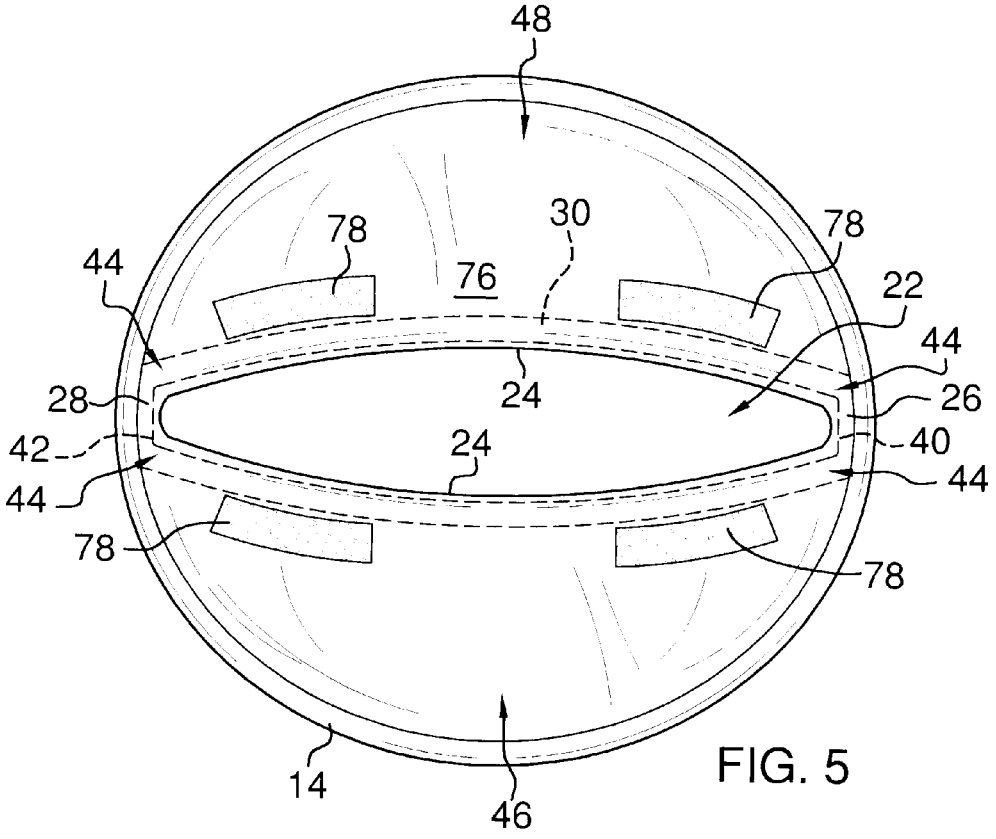
FIG. 5 is a bottom view of an embodiment of the disclosure.
Figure 6:
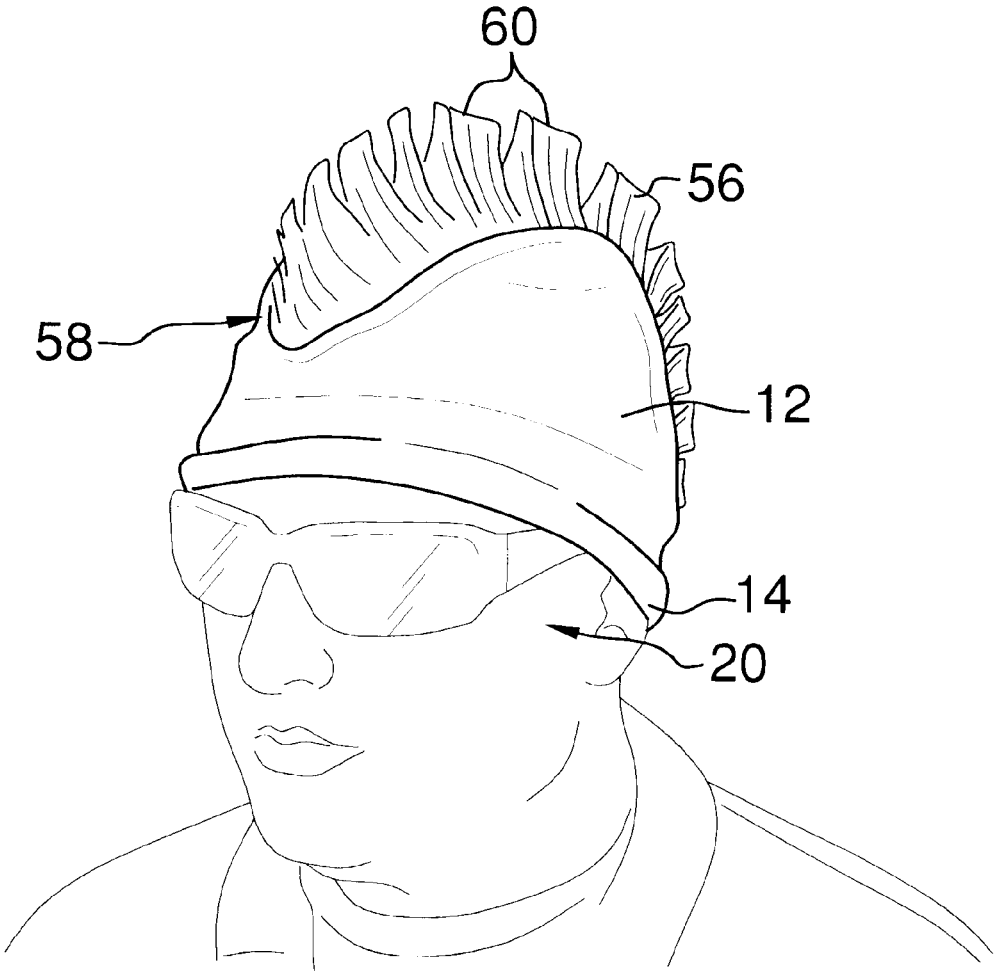
FIG. 6 is a front side perspective view of an embodiment of the disclosure in use.

With reference now to the drawings, and in particular to FIGS. 1 through 6 thereof, a new hat device embodying the principles and concepts of an embodiment of the disclosure and generally designated by the reference numeral 10 will be described.

As best illustrated in FIGS. 1 through 6, the hair style accommodating hat device 10 generally comprises a main member 12 having an annular perimeter edge 14 and a convex central portion 16 extending from the perimeter edge 14 defining an interior space 18 wherein the main member 12 is configured to be worn on a head 20. The main member 12 may be constructed of a flexible material such as stitched wool, cotton, or the like commonly used to make hats used seasonally to keep the head 20 warm. An elongated slot 22 extends through the central portion 16 of the main member 12 and has spaced longitudinal side edges 24. Thus, the slot 22 is configured for receiving an elongated strip of hair through the slot 22 while the main member 12 is coupled to the head 20 to keep the head 20 warm. The hair may be the natural hair of the person wearing the main member 12. The slot 22 is centrally positioned through the main member 12 extending from a front 26 of the main member 12 to a back 28 of the main member 12.

A support frame 30 is coupled to the central portion 16 of the main member 12. The support frame 30 holds the slot 22 in an open position 34. The support frame 30 has a pair of curved long sides 36,38 and a pair of short ends 40,42 coupled to and extending between opposite ends 44 of the long sides 36,38 of the support frame 30. The support frame 30 is configured to nest against the head 20 in a comfortable fashion. Thus, the support frame 30 facilitates insertion of natural hair extending from the head 20 through the slot 22 when the main member 12 is positioned on the head 20. Sides 46,48 of the main member 12 cover sides of the head 20 which may be bald or significantly shortened when a user has a hairstyle commonly referred to as a mohawk.

A mohawk hairstyle may also be simulated using an insert 50 having a concave top surface 52 and a convex bottom surface 54. The insert 50 is selectively couplable to the main member 12 wherein the insert 50 extends along and closes the slot 22. Thus, the insert 50 may be used to cover the full top of the head 20 in combination with the main member 12 if so desired. A plurality of hairs 56 may be coupled to and extend from the top surface 52 of the insert 50 wherein the hairs 56 extend outwardly from the slot 22 when the insert 50 is coupled to the main member 12. The hairs 56 are arranged into a wedge shape 58 having a peak ridge 60 extending from a front 62 of the insert 50 towards a back 64 of the insert 50. To couple the insert 50 to the main member 12, a peripheral lip 66 is coupled to and extends outwardly from a peripheral edge 68 of the insert 50 aligning with an edge 70 of the slot 22. The peripheral lip 66 has an upper surface 74 coupled to a bottom surface 76 of the main member 12 extending around the slot 22. Complementary portions of hook and loop fastener 78 are coupled to the upper surface 74 of the peripheral lip 66 of the insert 50 and the bottom surface 76 of the main member 12 wherein the insert 50 is couplable to the main member 12.

In use, the main member 12 is placed on the head 20 such that the head 20 is inserted into the interior space 20. Natural hair is extended through the slot 22 allowing the main member 12 to cover the rest of the head 20 or the insert 50 may be coupled to the main member 12 to cover the whole head 20 or provide the appearance of having a mohawk hairstyle extending through the slot 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hairstyle accommodating hat device, comprising:

a main member having an annular perimeter edge and a convex central portion extending from said perimeter edge defining an interior space wherein said main member is configured to be worn on a head; and an elongated slot extending through said central portion of said main member, said slot having spaced longitudinal side edges wherein said slot is configured for receiving an elongated strip of natural hair through said slot while said main member is coupled to the head, said slot being centrally positioned through said main member extending from a front of said main member proximate to said perimeter edge to a back of said main member proximate to said perimeter edge when worn;

a support frame coupled to said central portion of said main member, said support frame holding said slot in an open position, said support frame having a pair of curved long sides and a pair of short ends coupled to and extending between opposite ends of said long sides of said support frame.

2. The device of claim 1, further comprising an insert having a concave top surface and a convex bottom surface, said insert being selectively couplable to said main member such that said insert extends along and closes said slot.

3. The device of claim 2, further comprising a plurality of simulated hairs coupled to and extending from said top surface of said insert wherein said hairs extend outwardly from said slot when said insert is coupled to said main member.

4. The device of claim 3, further comprising said hairs being arranged into a wedge shape having a peak ridge extending from a front of said insert towards a back of said insert.

5. The device of claim 2, further comprising a peripheral lip extending outwardly from a peripheral edge of said insert, said peripheral lip having an upper surface coupled to a bottom surface of said main member extending around said slot.

6. The device of claim 5, further comprising complementary portions of hook and loop fastener coupled to said upper surface of said peripheral lip of said insert and said bottom surface of said main member wherein said insert is removably couplable to said main member.

7. The device of claim 1, further comprising said slot being centrally positioned through said main member extending from a front of said main member to a back of said main member.

8. A hairstyle accommodating hat device, comprising:

a main member having an annular perimeter edge and a convex central portion extending from said perimeter edge defining an interior space wherein said main member is configured to be worn on a head;

an elongated slot extending through said central portion of said main member, said slot having spaced longitudinal side edges wherein said slot is configured for receiving an elongated strip of natural hair through said slot while said main member is coupled to the head, said slot being centrally positioned through said main member extending from a front of said main member proximate to said perimeter edge to a back of said main member proximate to said perimeter edge when worn;

a support frame coupled to said central portion of said main member, said support frame holding said slot in an open position, said support frame having a pair of curved long sides and a pair of short ends coupled to and extending between opposite ends of said long sides of said support frame;

an insert having a concave top surface and a convex bottom surface, said insert being selectively coupled to said main member wherein said insert extends along and closes said slot;

a plurality of simulated hairs coupled to and extending from said top surface of said insert wherein said hairs extend outwardly from said slot when said insert is coupled to said main member, said hairs being arranged into a wedge shape having a peak ridge extending from a front of said insert towards a back of said insert;

a peripheral lip extending outwardly from a peripheral edge of said insert, said peripheral lip having an upper surface coupled to a bottom surface of said main member extending around said slot; and complementary portions of hook and loop fastener coupled to said upper surface of said peripheral lip of said insert and said bottom surface of said main member wherein said insert is removably coupled to said main member.

* * * * *